US007056398B2

(12) United States Patent
Yazawa et al.

(10) Patent No.: US 7,056,398 B2
(45) Date of Patent: Jun. 6, 2006

(54) METHOD OF MAKING FERRITIC STAINLESS STEEL SHEET HAVING EXCELLENT DEEP-DRAWABILITY AND BRITTLE RESISTANCE TO SECONDARY PROCESSING

(75) Inventors: Yoshihiro Yazawa, Chiba (JP); Osamu Furukimi, Chiba (JP); Yasushi Kato, Chiba (JP); Yoshihiro Ozaki, Chiba (JP)

(73) Assignee: JFE Steel Corporation (JP)

( * ) Notice: Subject to any disclaimer, the term of this patent is extended or adjusted under 35 U.S.C. 154(b) by 5 days.

(21) Appl. No.: 10/671,384

(22) Filed: Sep. 24, 2003

(65) Prior Publication Data

US 2004/0055674 A1 Mar. 25, 2004

Related U.S. Application Data

(62) Division of application No. 10/282,535, filed on Oct. 29, 2002, now Pat. No. 6,911,098.

(30) Foreign Application Priority Data

Oct. 31, 2001 (JP) ..... 2001-334175

(51) Int. Cl.
*C21D 8/04* (2006.01)

(52) U.S. Cl. ..... 148/610; 148/651; 148/542

(58) Field of Classification Search ..... 148/610, 148/605, 542, 325, 661, 537
See application file for complete search history.

(56) References Cited

U.S. PATENT DOCUMENTS 5,653,825 A 8/1997 Kohno et al.
6,383,309 B1 5/2002 Hirata et al.
2001/0003293 A1 6/2001 Hirata et al.

FOREIGN PATENT DOCUMENTS

EP 0 625 584 A1 11/1994
EP 0 727 502 A1 8/1996
EP 0 758 685 A1 2/1997
EP 0 765 941 A1 4/1997

(Continued)

OTHER PUBLICATIONS

M.-Y. Huh et al., *Effect of intermediate annealing on texture, formability and ridging of 17% Cr ferritic stainless steel sheet*, Material Science & Engineering A, vol. 308, Jun. 1, 2001, pp. 74-87.

*Primary Examiner*—Deborah Yee
(74) *Attorney, Agent, or Firm*—DLA Piper Rudnick Gray Cary US LLP

(57) ABSTRACT

A ferritic stainless steel sheet contains abut 0.01 percent by mass or less of carbon; about 1.0 percent by mass or less of silicon; about 1.5 percent by mass or less of manganese; about 11 to about 23 percent by mass of chromium; about 0.06 percent by mass or less of phosphorous; about 0.03 percent by mass or less of sulfur; about 1.0 percent by mass or less of aluminum; about 0.04 percent by mass or less of nitrogen; about 0.0005 to about 0.01 percent by mass of boron; about 0.3 percent by mass or less of vanadium; about 0.8 percent by mass or less of niobium and/or about 1.0 percent by mass or less of titanium wherein $18 \leqq Nb/(C+N)+2(Ti/(C+N)) \leqq 60$; and the balance being iron and unavoidable impurities. The average crystal grain diameter is about 40 μm or less and the average surface roughness is about 0.3 μm or less.

8 Claims, 1 Drawing Sheet

FOREIGN PATENT DOCUMENTS

| | | |
|---|---|---|
| EP | 1 099 773 A1 | 5/2001 |
| GB | 1045641 | 10/1966 |
| JP | 08-109443 | 4/1996 |
| JP | 08-283914 | 10/1996 |
| JP | 09-125208 | 5/1997 |
| JP | 2000-144344 | 5/2000 |

FIGURE
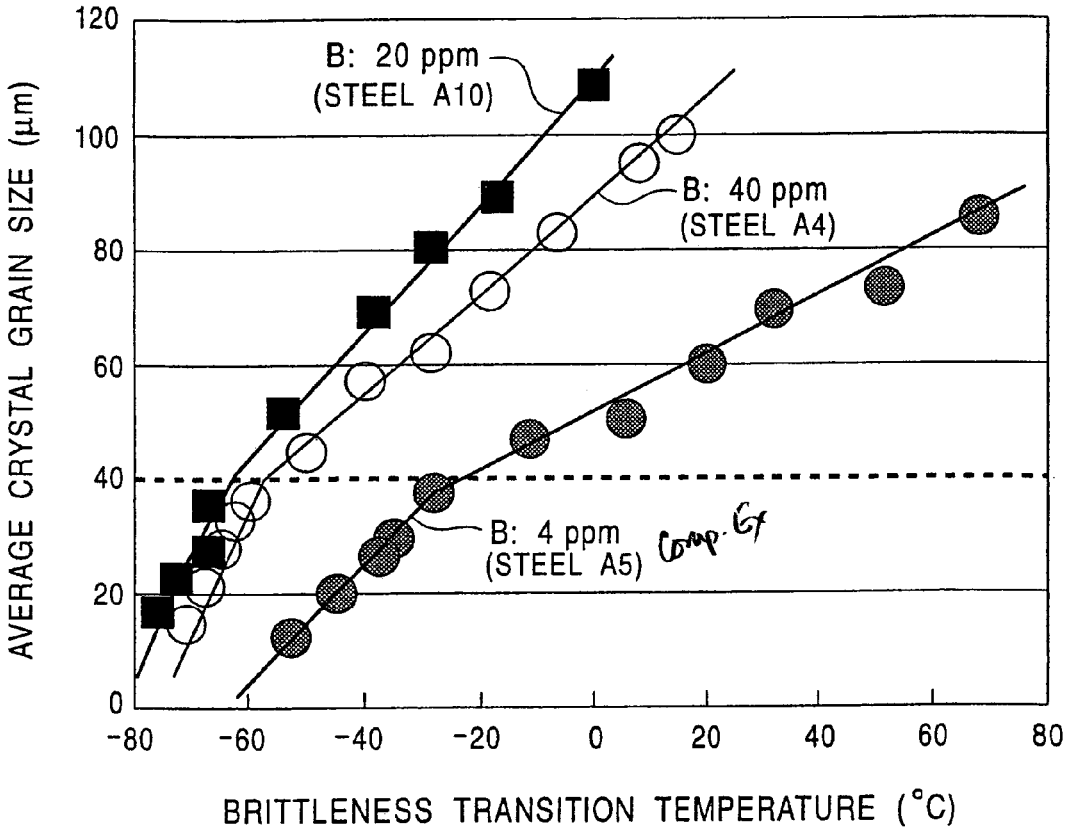

METHOD OF MAKING FERRITIC STAINLESS STEEL SHEET HAVING EXCELLENT DEEP-DRAWABILITY AND BRITTLE RESISTANCE TO SECONDARY PROCESSING

This application is a divisional of application Ser. No. 10/282,535, filed Oct. 29, 2002, now U.S. Pat. No. 6,911,098 issued Jun. 28, 2005, incorporated herein by reference.

BACKGROUND OF THE INVENTION

1. Field of the Invention

This invention relates to a cold-rolled ferritic stainless steel sheet having excellent deep-drawability, brittle resistance to secondary processing, compatibility with overcoating, and corrosion resistance suitable for use in outer panels and strengthening members of automobiles and the like. The invention also relates to a method for making the cold-rolled ferritic stainless steel sheet.

2. Description of the Related Art

Generally, outer panels and strengthening members of automobiles are made by press-forming high tensile strength steel sheets of a 440 Mpa class. Such steel sheets are generally subjected to surface treatment, such as plating, before working or to coating treatment after working to improve the corrosion resistance. In actual operation, however, when plated steel sheets are worked, they suffer from peeling of plated material. Such peeling causes rust to occur, which is a problem. Coating treatment after working cannot completely cover the minute details of complicated shapes. Rust occurs in the uncoated minute portions, which is a problem. Stainless steel sheets having high corrosion resistance are preferably used to prevent generation of rust resulting from insufficient plating or coating or the like. Austenitic stainless steel sheets, such as SUS 304, which contain a large amount of expensive nickel as a component, are themselves expensive. Hence, the cost is high compared with conventional coated steel sheets. In contrast, although ferritic stainless steel sheets are relatively inexpensive, they have low workability, e.g., low press-formability, and improvements as to this point are required.

In conventional technologies, improvement in workability, i.e., deep-drawability, and more specifically, an increase in r-value, of ferritic stainless steel sheets has been achieved by increasing the annealing-temperature of cold-rolled sheets to promote the development of the {111} recrystallization structure effective for increasing the r-value, thereby increasing the ductility and the r-value. Japanese Unexamined Patent Publication No. 9-241738 discloses a technology whereby after carbon and nitrogen in the steel are decreased to 100 ppm or less, the remaining carbon and nitrogen are fixed as deposits by a carbide/nitride forming element such as Ti or Nb, and boron (B) is added to the steel to make ferritic stainless steel sheets having highly balanced ductility and r-value.

However, stainless steel sheets must have a higher deep-drawability to be press-formed into complicated shapes such as those required by outer panels or strengthening members of automobiles. The r-value of the conventional ferritic stainless steels has been 1.8 at most. However, the average r-value should be increased to 2.0 or more to be effective.

Workability, such as deep-drawability, can be improved by reducing solid-solution carbon and nitrogen and by adding boron, as described above. For example, stainless steel is formed into fuel tanks or the like. The resulting stainless steel products to which high strain is applied during a drawing process suffer from brittle fracture when an external force is applied thereto such as by flying stones or collision, for example. This is called brittleness to secondary processing. The brittle resistance to secondary processing indicates the brittle resistance to an external force applied to a deep-drawn product. This property is of a particular importance in cold climates such as northern North America, e.g., Alaska.

The deep-drawability, and more specifically the r-value, of ferritic stainless steel sheets has been improved by increasing the annealing temperature of the cold-rolled sheets to promote the development of the {111} recrystallization structure effective for increasing the r-value and to thereby increase the ductility and the r-value, as described above. However, high-temperature annealing increases the size of crystal grains of cold-rolled annealed sheets, thereby roughening the surface after working and decreasing the brittle resistance to secondary processing. Although Japanese Unexamined Patent Publication No. 9-241738, etc., disclose adding boron, as described above, no reference is made regarding the brittle resistance to secondary processing. The technology disclosed in Japanese Unexamined Patent Publication No. 9-241738 cannot achieve both high deep-drawability, i.e., the r-value of 2.0 or more, and high brittle resistance to secondary processing in cold climates, e.g., at an ambient temperature of −60° C.

No ferritic stainless steel sheets having both excellent deep-drawability and high brittle resistance to secondary processing has been developed. These two properties must be simultaneously achieved for the ferritic stainless steel sheets to be used as outer panels or strengthening members of automobiles or the like.

It is accordingly an object of the invention to achieve an r-value of 2.0 or more (deep-drawability) and a brittle resistance to secondary processing free of longitudinal cracking in a drop weight test at a low-temperature of −60° C. or less simulating the ambient environment of automobiles and the like.

When components made of ferritic stainless steel are used in coastal areas or districts where salt is used to melt snow and ice, the components may suffer from a decrease in brittle resistance to secondary processing and in corrosion resistance due to salt, even though the ferritic stainless steels generally have superior corrosion resistance. To overcome this problem, the components may be provided with a light coating or the like to further enhance the brittle resistance and the corrosion resistance and to widen the applicable range of ferritic stainless steels. Thus, it is another object of the invention to develop a coated steel which can be suitably used in such conditions.

SUMMARY OF THE INVENTION

This invention provides a ferritic stainless steel sheet having superior deep-drawability and brittle resistance to secondary processing and a method for making the ferritic stainless steel sheet. We have conducted extensive investigations on the characteristics of ultra-low-carbon-based ferritic stainless steel sheets and found that a ferritic stainless steel sheet having high deep-drawability, brittle resistance to secondary processing, and corrosion resistance after coating can be manufactured by optimizing the content of boron, niobium, titanium, and vanadium, by controlling the average crystal grain size of the steel sheet after finish-annealing and pickling or further after skin-pass rolling to about 40 μm or less, and by simultaneously controlling the average surface roughness Ra of the steel sheet to about 0.30 μm or less.

A first aspect of the invention provides a ferritic stainless steel sheet including about 0.01 percent by mass or less of carbon; about 1.0 percent by mass or less of silicon; about 1.5 percent by mass or less of manganese; about 11 to about 23 percent by mass of chromium; about 0.06 percent by mass or less of phosphorous; about 0.03 percent by mass or less of sulfur; about 1.0 percent by mass or less of aluminum; about 0.04 percent by mass or less of nitrogen; about 0.0005 to about 0.01 percent by mass of boron; about 0.3 percent by mass or less of vanadium; about 0.8 percent by mass or less of niobium and/or about 1.0 percent by mass or less of titanium wherein $18 \leqq Nb/(C+N)+2(Ti/(C+N)) \leqq 60$; and the balance being iron and unavoidable impurities. The average crystal grain diameter is about 40 μm or less and the average surface roughness is about 0.3 μm or less.

Preferably, the ferritic stainless steel sheet further includes about 0.0007 to about 0.0030 percent by mass of calcium and/or at least one of about 0.1 to about 1.0 percent by mass of copper; about 0.05 to about 0.2 percent by mass of cobalt; and about 0.1 to about 2.0 percent by mass of nickel, wherein $0.05<(0.55\times Cu+0.85\times Co+Ni)<0.30$.

The ferritic stainless steel sheet may be provided with a resin coating film having a thickness of about 2.0 μm or more on a surface thereof. The resin coating film is preferably made of a urethane resin or an epoxy resin.

A second aspect of the invention provides a method for making a ferritic stainless steel sheet, including the steps of hot-rolling a steel slab comprising about 0.01 percent by mass or less of carbon; about 1.0 percent by mass or less of silicon; about 1.5 percent by mass or less of manganese; about 11 to about 23 percent by mass of chromium; about 0.06 percent by mass or less of phosphorous; about 0.03 percent by mass or less of sulfur; about 1.0 percent by mass or less of aluminum; about 0.04 percent by mass or less of nitrogen; about 0.0005 to about 0.01 percent by mass of boron; about 0.3 percent by mass or less of vanadium; about 0.8 percent by mass or less of niobium and/or about 1.0 percent by mass or less of titanium wherein $18 \leqq Nb/(C+N)+2(Ti/(C+N)) \leqq 60$; and the balance being iron and unavoidable impurities to make a hot-rolled sheet; annealing the hot-rolled sheet to prepare an annealed sheet; cold-rolling the annealed sheet either once or at least two times with intermediate annealing to prepare a cold-rolled sheet; and finish-annealing and pickling the cold rolled sheet to prepare a pickled steel sheet. The pickled steel sheet contains crystal grains having an average crystal grain diameter of about 40 μm or less and has an average surface roughness of about 0.3 μm or less.

In the above-described method, the steel slab preferably further includes about 0.0007 to about 0.0030 percent by mass of calcium and/or at least one of about 0.1 to about 1.0 percent by mass of copper; about 0.05 to about 0.2 percent by mass of cobalt; and about 0.1 to about 2.0 percent by mass of nickel, wherein $0.05<(0.55\times Cu+0.85\times Co+Ni)<0.30$.

Preferably, the method further includes the step of skin-pass rolling the pickled steel sheet. More preferably, the method further includes the step of forming a resin coating film having a thickness of about 2.0 μm on a surface of the ferritic steel sheet. The resin coating film is preferably made of one of urethane resins and epoxy resins.

BRIEF DESCRIPTION OF THE DRAWINGS

FIG. 1 is a graph showing the dependency of the boron content and the average crystal grain diameter on the brittleness transition temperature.

DESCRIPTION OF SELECTED EMBODIMENTS

The composition of a ferritic stainless steel sheet of the invention will now be described.

C: about 0.01 percent by mass or less

Solid-solution carbon in steel decreases elongation and r-value. Preferably, carbon is removed as much as possible during the steel making process. The solid-solution carbon is fixed as carbides by titanium (Ti) and niobium (Nb), as described below. However, at a carbon content exceeding about 0.01 percent by mass, Ti and Nb cannot sufficiently fix carbon and solid-solution carbon remains to decrease the r-value and the elongation. Thus, the carbon content is limited to about 0.01 percent by mass or less. The carbon content is preferably about 0.0020 percent by mass or less, and more preferably, about 0.0010 percent by mass or less to increase the revalue and elongation.

Si: about 1.0 percent by mass or less

Silicon (Si) enhances oxidation resistance and corrosion resistance, particularly the corrosion resistance in air. Addition of about 0.02 percent by mass or more of silicon is necessary to obtain sufficient oxidation and corrosion resistance. However, silicon in an amount exceeding about 1.0 percent by mass decreases the toughness of the steel and the brittle resistance to secondary processing at welds. Thus, the silicon content is limited to about 1.0 percent by mass or less, and more preferably, in the range of about 0.1 to about 0.6 percent by mass.

Mn: about 1.5 percent by mass or less

Manganese (Mn) forms manganese sulfide (MnS) and renders sulfur (S) harmless, which deteriorates the hot-workability of the steel. Manganese in an amount of less than about 0.05 percent by mass cannot sufficiently render sulfur harmless. The effect of manganese is saturated at an amount exceeding about 1.5 percent by mass. Moreover, manganese in an amount exceeding about 1.5 percent by mass decreases elongation due to solid-solution hardening. Thus, the preferable amount of manganese is about 1.5 percent by mass or less, and more preferably about 0.25 percent by mass or less.

Cr: about 11 to about 23 percent by mass

Chromium (Cr) enhances oxidation resistance and corrosion resistance. To achieve sufficient oxidation resistance and corrosion resistance, about 11 percent by mass or more of chromium must be contained in the steel. In view of obtaining sufficient corrosion resistance of welds, the chromium content is preferably about 14 percent by mass or more. On the other hand, chromium decreases the workability of the steel. Deterioration in workability is significant when chromium is contained in an amount exceeding about 23 percent by mass. Thus, the chromium content is limited to the range of about 11 to about 23 percent by mass, and more preferably, about 14 to about 20 percent by mass.

P: about 0.06 percent by mass or less

Phosphorous (P) tends to segregate in grain boundaries. Thus, when boron is added, phosphorous diminishes the grain-boundary-strengthening effect of boron and deteriorates the brittle resistance to secondary processing at the welds. Moreover, phosphorous deteriorates the workability, the toughness, and the high-temperature fatigue characteristics of the steel. The content of phosphorous is thus preferably as low as possible, i.e., about 0.06 percent by mass or less, and more preferably, about 0.03 percent by mass or less. However, the cost of steel production increases if the phosphorous content is reduced excessively.

S: about 0.03 percent by mass or less

Sulfur (S) is an impurity that deteriorates formability and decreases the corrosion resistance of the steel sheet. The content of sulfur is preferably reduced as much as possible during the steel making process. However, as with phosphorous described above, excessive reduction causes an increase in the cost of steel production. Considering the balance between the cost and the properties, the sulfur content is about 0.03 percent by mass or less, and more preferably, about 0.01 percent by mass or less. At a content of about 0.01 percent by mass or less, sulfur can be fixed by Mn or Ti.

Al: about 1.0 percent by mass or less

Aluminum (Al) must be contained in the steel in an amount of about 0.001 percent by mass or more as a deoxidizer during steel making. However, aluminum in an amount exceeding about 1.0 percent by mass decreases the elongation due to solid-solution hardening. Moreover, excess aluminum generates inclusions that deteriorates the cosmetic appearance and deteriorates the corrosion resistance. Thus, the aluminum content is limited to about 1.0 percent by mass or less, more preferably in the range of about 0.001 to about 0.6 percent by mass, and most preferably, in the range of about 0.01 to about 0.2 percent by mass.

N: about 0.04 percent by mass or less

Nitrogen (N) is an impurity and titanium (Ti) forms titanium nitride (TiN) and renders nitrogen harmless. Nitrogen in an amount exceeding about 0.04 percent by mass requires a large amount of additive titanium and the ductility of the resulting steel sheet deteriorates due to the precipitation hardening of TiN. Although nitrogen improves the toughness and strengthens grain boundaries, excess nitrogen precipitates in the grain boundaries as nitrides and deteriorates the corrosion resistance. Thus, the nitrogen content is limited to about 0.04 percent by mass or less. The nitrogen content is preferably about 0.002 percent by mass or less to further improve formability.

B: about 0.0005 to about 0.01 percent by mass

Boron (B) segregating in grain boundaries increases the grain boundary strength and enhances the brittle resistance to secondary processing. Moreover, boron forms boron nitride (BN) which prevents the precipitation of TiN which deteriorates the toughness of the resulting steel. Boron must be contained in an amount of 0.0005 percent by mass or more to sufficiently obtain these effects. Since excess boron deteriorates the hot-workability of the steel, the boron content is limited to about 0.01 percent by mass or less.

V: about 0.3 percent by mass or less

Vanadium (V) is an important element in the invention. Vanadium stabilizes carbon and nitrogen, but in the invention, a portion of titanium is replaced with vanadium and vanadium is added in combination with boron to the steel to improve toughness. About 0.0 1 percent by mass or more of vanadium is required to achieve the improvement in toughness. The upper limit is about 0.3 percent by mass since excess vanadium deteriorates workability due to hardening.

Nb: about 0.8 percent by mass or less; Ti: about 1.0 percent by mass or less; and $18 \leqq Nb/(C+N)+2(Ti/(C+N)) \leqq 60$ Niobium (Nb) and titanium (Ti) fix solid-solution carbon, nitride, and the like by forming carbides or nitrides and thus enhance corrosion resistance and deep-drawability (the r-value). Niobium and titanium may be used alone or in combination. Titanium forms precipitants with impurities such as carbon, nitride, sulfur, and phosphorous to render these contaminants harmless. Niobium joins with carbon, i.e., an impurity of steel, to form niobium carbide (NbC). Niobium carbide decreases the grain size of the hot-rolled sheet, increases the r-value, prevents the growth of the crystal grains during finish annealing, and improves the brittle resistance to secondary processing by achieving a fine structure. The concentration of solid solution carbon is critical to adequately produce niobium carbide. As described below, niobium can exert a stronger effect when suitably used in combination with titanium.

The desired effects of niobium and titanium cannot sufficiently be obtained at an amount of less than about 0.01 percent by mass. They are preferably contained in the steel in an amount of about 0.01 percent by mass or more. Niobium in an amount exceeding about 0.8 percent by mass deteriorates the toughness. Titanium in an amount exceeding about 1.0 percent by mass decreases the toughness, and scratches on the cold rolled sheet caused by TiN become significant. Thus, the niobium content is about 0.8 percent by mass or less, and the titanium content is about 1.0 percent by mass or less.

The alloy design must satisfy the relationship $18 \leqq Nb/(C+N)+2(Ti/(C+N)) \leqq 60$ to fix carbon and nitrogen in the steel as carbides and nitrides and obtain a higher workability. Each of the C content, N content, Nb content, and Ti content is limited as above because at $Nb/(C+N)+2(Ti/(C+N))$ of less than 18, carbon and nitrogen in the steel cannot sufficiently be fixed as carbides and nitrides and the workability and the corrosion resistance are significantly deteriorated. The precipitants of carbides and nitrides increase to deteriorate workability at $Nb/(C+N)+2(Ti/(C+N))$ exceeding 60. The relationship $(Ti+V)/(C+N)=5$ to 50 is preferably satisfied in addition to satisfying the above-described content ranges of titanium and vanadium to sufficiently fix carbon and nitrogen.

In addition to the components described above, the steel sheet of the invention may contain the components described below where required.

At least one of about 0.1 to about 1.0 percent by mass of Cu, about 0.05 to about 0.2 percent by mass of Co, and about 0.1 to about 2.0 percent by mass of Ni, wherein $0.05<(0.55\times Cu+0.85\times Co+Ni)<0.30$ Copper (Cu), cobalt (Co), and nickel (Ni) improve the corrosion resistance, low-temperature toughness, and brittle resistance to secondary processing of the stainless steel. The stainless steel preferably includes at least one of about 0.1 to about 1.0 percent by mass of Cu, about 0.05 to about 0.2 percent by mass of Co, and about 0.1 to about 2.0 percent by mass of Ni, while satisfying the relationship $0.05<(0.55\times Cu+0.85\times Co+Ni)<0.30$. These elements show little effect when they are contained in amounts less than the ranges described above. These elements, if contained in amounts exceeding the above ranges, harden the steel and generate the austenitic phase which may cause stress corrosion cracking.

Ca: about 0.0007 to about 0.0030 percent by mass

A trace amount of calcium (Ca) effectively prevents clogging of immersion nozzles which readily occurs due to titanium inclusions during continuous casting of titanium-containing steel. The amount of the calcium must be at least about 0.0007 percent by mass to prevent clogging. Calcium in an amount exceeding about 0.0030 percent by mass dramatically deteriorates the corrosion resistance. A more preferable range of the calcium content is about 0.0010 to about 0.0015 percent by mass.

The balance of the steel is iron (Fe) and unavoidable impurities. The stainless steel may include about 0.5 percent by mass or less of zirconium (Zr), about 0.3 percent by mass or less of tantalum (Ta), about 0.3 percent by mass or less of tungsten (W), about 0.3 percent by mass or less of tin (Sn), and about 0.005 percent by mass of magnesium (Mg), if necessary, since these elements in such amounts do not significantly affect the characteristics of the stainless steel of the invention.

The characteristics of the ferritic stainless steel sheet after finish-annealing and pickling or after finish-annealing, pickling, and skin-pass rolling will now be described.

a. Average crystal grain diameter: about 40 μm or less

The average crystal grain diameter and the average surface roughness of the cold-rolled steel sheet have a large effect on the brittle resistance to secondary processing and the surface roughness after working. Preferably, the average crystal grain diameter is as small as possible, and the average surface roughness is as low as possible. A large average crystal grain diameter of the cold rolled sheet after finish-rolling and pickling or after finish-rolling, pickling, and skin-pass rolling causes the surface of a deep-drawn product to exhibit significant irregularities and thus a decrease in the brittle resistance to secondary processing. Moreover, surface roughening called "orange peel" is observed at the surface of the worked product, thereby impairing the cosmetic appearance. This problem is particularly acute at an average crystal grain diameter exceeding about 40 μm. Thus, the average crystal grain diameter is about 40 μm or less, and preferably, about 35 μm or less. Although the characteristics such as resistance to secondary processing improve as the average crystal grain diameter becomes smaller, the manufacturing load, particularly the load during the hot-rolling process, for obtaining fine grains is heavy. Thus, the lower limit of the average crystal grain diameter is about 5 μm.

b. The average surface roughness Ra: about 0.3 μm or less

The average surface roughness Ra is a foremost important characteristic in the invention. The average surface roughness Ra after cold-roll finish annealing and pickling or after cold-roll finish annealing, pickling, and skin-pass rolling has a large effect on the brittle resistance to secondary processing of the worked product, as does the average crystal grain diameter of the cold rolled sheet. Even when the average crystal grain diameter is adjusted to about 40 μm or less, the brittle resistance to secondary processing is deteriorated at an average surface roughness Ra exceeding about 0.3 μm. Thus, the upper limit of the average surface roughness Ra is about 0.3 μm. The average surface roughness Ra also affects the adhesion of the coating film. The adhesion of the coating film is improved at an average surface roughness Ra of about 0.05 μm or more. Moreover, the average surface roughness Ra significantly affects the deep-drawability of the steel sheet. An average surface roughness Ra less than about 0.05 μm increases the contact resistance, i.e., the friction resistance, between the mold and the steel sheet, thereby deteriorating the deep-drawability. This is because an excessively smooth surface of the steel sheets cannot sufficiently hold lubricating oil, but increases the contact area with the mold, thereby resulting in an increase in friction resistance and deterioration in deep-drawability. The average surface roughness Ra is preferably in the range of about 0.05 to about 0.3 μm to balance these characteristics.

The average surface roughness Ra is preferably adjusted by controlling the roll roughness and the reduction rate during the final cold rolling or during the skin-pass rolling performed after finish annealing and pickling. The surface roughness may also be adjusted by controlling the conditions of pickling performed after finish annealing, such as acid concentration, temperature, and pickling time.

c. Thickness of the resin coating film: about 2 μm or more

The steel sheet of the invention exhibits superior corrosion resistance after being provided with resin coating. The thickness of the resin coating needs to be at least about 2 μm to stably provide sufficient corrosion resistance. Thinning of the steel sheet due to rust and corrosion becomes significant at a thickness less than about 2 μm. The resin coating may be applied by any known coating method including spraying coating, brush coating, powder coating, cationic electrodeposition coating, or the like. Since the steel sheet of the invention has a superior corrosion resistance to that of ordinary steel, a sufficient corrosion resistance can be obtained with a thin coating film given that a sufficient adhesion between the resin coating film and steel sheet is provided. The upper limit of the film thickness is about 50 μm. With a coating film having a thickness exceeding about 50 μm, the rust resistance becomes saturated and work efficiency, such as time for drying the applied coat, is deteriorated. The thickness of the coating film is preferably about 50 μm or less.

The cold-rolled steel sheet of the invention is made through the steps of steel making, hot rolling (slab heating, rough rolling, and finish rolling), hot-sheet annealing, pickling, cold rolling, finish annealing, pickling, and, if necessary, skin-pass rolling. The manufacturing conditions of each of these steps will be described below.

(1) Slab Heating

When the temperature during slab heating is low, hot rough rolling under predetermined conditions becomes difficult. On the other hand, when the heating temperature is excessively high, the texture of the hot-rolled sheet becomes uneven in the sheet thickness direction. Moreover, $Ti_4C_2S_2$ deposits melt and the amount of the solid solution carbon in the steel sheet before final cold-rolling increases, resulting in a decrease in r-value. Thus, the slab heating temperature is preferably in the range of about 1,000 to about 1,200° C., and more preferably, about 1,050 to about 1,200° C.

(2) Hot Rough Rolling

Hot rough rolling, hereinafter simply referred to as "rough rolling", is performed at about 850 to about 1,100° C. at a reduction rate of about 35% or more for at least one pass. If the rolling temperature during rough rolling is below about 850° C., recrystallization is inhibited and a coarse (100) colony resulting from the columnar structure of the slab remains. Thus, the workability after finish annealing is deteriorated and the load applied on the rolls becomes larger and shortens the lifetime of the rolls. At a temperature exceeding about 1,100° C., the ferrite crystal grains become coarse, the grain boundary area, i.e., the {111} nuclei generation site, decreases, and the r-value of the steel sheet after finish annealing decreases. Accordingly, the rolling temperature during rough rolling is in the range of about 850 to about 1100° C., and more preferably about 900 to about 1,050° C.

During rough rolling, at least one pass is performed at a reduction rate of about 35% or more. At reduction rate below about 35%, a banded unrecrystallized structure remains in a large amount at the center portion of the steel sheet in the sheet thickness direction, thereby deteriorating the deep-drawability. When the reduction rate for each pass during rough rolling exceeds about 60%, seizure occurs between the roll and the steel sheet and the roll may not properly bite the steel sheet. Thus, the reduction rate of at least one pass is preferably in the range of about 35 to about 60%.

A steel having a low high-temperature strength, for example, a steel having a high-temperature strength (TS) of about 20 MPa or less at 1,000° C. measured according to Japanese Industrial Standard (JIS) G 0567, suffers from strong shear strain at the steel sheet surface during rough rolling. As a result, the unrecrystallized structure remains at the center portion in the sheet thickness direction and seizure may occur between the roll and the steel sheet. In such a case, lubricating treatment may be performed to reduce the friction coefficient to about 0.3 or less.

The rough rolling step satisfying the above-described rolling temperature conditions and the reduction condition is performed for at least one pass to improve the deep-drawability. This at least one pass may be performed at any pass. However, such rough rolling is preferably performed at the last pass from the point of view of the performance of the rolling machine.

(3) Hot Finish Rolling

Hot finish rolling following the rough rolling, hereinafter simply referred to as "finish rolling", is preferably performed at a rolling temperature of about 650 to about 900° C. at a reduction rate of about 20 to about 40% for at least one pass. At a rolling temperature below about 650° C., the reduction rate of about 20% or more is difficult to achieve since the deformation resistance increases. Moreover, the roller pressure also increases. On the other hand, at a rolling temperature exceeding about 900° C., the accumulation of the rolling strain is small, and so is the effect of improving the deep-drawability in the subsequent steps. Thus, the finish-rolling temperature is in the range of about 650 to about 900° C., and more preferably, about 700 to about 800° C.

At a reduction rate less than about 20% at about 650 to about 900° C. during finish rolling, a (100)//ND colony, i.e., the (100) colony parallel to the normal direction with respect to the steel sheet surface, and (110)//ND colony, the (110) colony parallel to the normal direction with respect to the steel sheet surface, (Yokota et al., Kawasaki Steel Giho, 30 (1998) 2, p. 115) which decrease the r-value and cause ridging remain over significantly large areas. A reduction rate exceeding about 40% causes biting failures and shape defects in the steel sheets, resulting in deterioration of the surface characteristics of the steel. Thus, during finish rolling, rolling at a reduction rate of about 20 to about 40% is preferably performed for at least one pass. More preferably, the reduction rate is in the range of about 25 to about 35%.

Deep-drawability can be improved by performing at least one pass of finish rolling that satisfies the above described rolling temperature conditions and the reduction rate conditions. This at least one pass maybe performed at any pass. However, from the point of view of the performance of the rolling machine, it is preferably performed at the last pass.

(4) Hot-Rolled-Sheet Annealing

Hot-rolled-sheet annealing at a temperature below about 800° C. results in insufficient recrystallization which decreases the r-value of the resulting cold-rolled steel sheet and allows the banded structure to remain in the steel. As a result, significant ridging occurs in the resulting finish annealed sheet. At an annealing temperature exceeding about 1,100° C., the structure becomes coarse, resulting in the surface roughening after working, a decrease in the forming limit, and deterioration of the corrosion resistance. Moreover, since carbides that fix solid solution carbon melt again, the amount of the solid solution carbon in the steel increases, thereby inhibiting the formation of the desirable {111} recrystallization structure. Thus, the hot-rolled-sheet annealing is preferably performed at a temperature in the range of about 800 to about 1,100° C., and more preferably, in the range of about 800 to about 1,050° C.

Note that when a single-stage cold rolling method is employed during the cold rolling process, the hot-rolled-sheet annealing becomes the annealing process before the final cold rolling. Thus, the annealing temperature is preferably in the low-temperature side of the above-described temperature range to reduce the amount of solid solution carbon and decrease the crystal grain diameter.

(5) Cold Rolling

Either one of a single-stage cold rolling method and a multi-stage cold rolling method with intermediate annealing between cold rolling may be employed. The total reduction rate is about 75% or more in both single-stage cold rolling method and the multi-step cold rolling method. In a multi-stage cold rolling process, the total reduction rate need only be achieved over two or more rolling stages. Preferably, the reduction ratio indicated by (reduction rate during first cold rolling)/(reduction rate during final cold rolling) is in the range of about 0.7 to about 1.3. An increase in total reduction rate increases the concentration of the {111} recrystallization structure in the finish-annealed sheet and thus increases the revalue. To achieve a high r-value of about 2.0 or more or about 2.2 or more, the total reduction rate must be at least about 75%, and is preferably at least about 80%, but less than about 90%. It is also important to adjust the ferrite crystal grain diameter substantially immediately before final cold rolling to about 40 μm or less.

The diameter of the roll and direction of rolling during cold rolling are preferably adjusted to reduce the shear deformation at the surface of the rolled sheet, to increase the (222)/(200) ratio, and to effectively increase the r-value. A unidirectional tandem rolling with a roll diameter of about 400 mm or more is preferred over a reversing rolling with a roll diameter of about 100 to about 200 mm. This is because a unidirectional tandem rolling with a roll diameter of about 400 mm or more is effective for reducing the shear deformation at the surface and for increasing the concentration of the {111} recrystallization structure and the re-value.

A high r-value can be stably obtained by increasing the linear pressure, i.e., the rolling pressure/sheet width, to uniformly apply strain in the sheet thickness direction. The linear pressure is preferably at least about 3.5 MN/m. To obtain such a linear pressure, either one or a combination of decreasing the hot rolling temperature, forming high alloys, and increasing the hot rolling speed may be suitably employed.

The average surface roughness Ra (Japanese Industrial Standard B 0601) of the rolls of the final cold-rolling machine is preferably about 0.01 to about 10 μm, and the reduction rate is preferably about 0.05 to about 10% to reduce the average surface roughness Ra after finish annealing and pickling to about 0.3 μm or less.

(6) Intermediate Annealing

Intermediate annealing at a temperature below about 740° C. results in insufficient recrystallization and a decrease in r-value. Moreover, significant ridging occurs due to the banded structure. Intermediate annealing at a temperature exceeding about 940° C. results in coarse structures and causes carbides to return to solid solution carbon. Since the amount of solid solution carbon in the steel is increased, the preferable {111} recrystallization structure which improves the deep-drawability is inhibited from being formed.

In a multi-stage cold rolling, intermediate annealing is important for ensuring formation of fine crystal grains of about 40 μm or less, high r-values, and reduction of solid solution carbon before final cold rolling. The intermediate annealing temperature is preferably the lowest temperature that can achieve an average crystal grain diameter before final cold-rolling of about 40 μm or less and eliminate the unrecrystallized structure. Thus, the intermediate annealing temperature should be in the range of about 740 to about 940° C. The intermediate annealing temperature is preferably about 50° C. or more lower than the hot-rolled-sheet annealing temperature. The same applies when cold rolling is performed three times or more to roll a thick hot-rolled sheet. The intermediate annealing temperature should also be in the range of about 740 to about 940° C. in such a case.

(7) Finish Annealing

The {111} recrystallization structure can be selectively developed and higher r-values can be obtained at high finish-annealing temperatures. A finish-annealing temperature of less than about 800° C. cannot provide a crystal orientation effective for improving the r-value and cannot achieve an average r-value of about 2.0 or more. Furthermore, at such a temperature, the banded unrecrystallized structure remains at the center of the steel sheet in the sheet thickness direction and deteriorates the deep-drawability and the ridging resistance of the steel sheet. Although the r-value increases at high temperatures, an excessively high annealing temperature increases the crystal grain diameter of the cold-rolled annealed sheet to about 40 μm or more, thereby deteriorating the brittle resistance to secondary processing. Moreover, surface roughening, which causes deterioration in the forming limit and in corrosion resistance, occurs after working. A higher finish annealing temperature is preferred so that an average crystal grain diameter of about 40 μm or less is ensured. The steel sheet of the invention is preferably finish-annealed at a temperature in the range of about 700 to about 1,000° C., and more preferably about 850 to about 980° C. to balance the r-value and the brittle resistance to secondary processing.

(8) Pickling

The cold rolled sheet is pickled to remove the scale and the Cr-removing layer on the surface of the steel sheet subsequent to finish annealing. Pickling is performed by a combination of neutral salt electrolytic pickling, nitric-hydrofluoric mixed acid pickling, and nitric acid electrolysis. During the process, acid concentration, immersion time, acid temperature, and the like affect the acid-washability, i.e., the scale-removing property, and change the surface roughness resulting from the preceding cold rolling process. Accordingly, controlling the roughness of the cold-rolled sheet and optimizing the pickling conditions are necessary, particularly when a 2D-finished steel sheet product, i.e., a steel sheet product which has been annealed and pickled after cold rolling but not subjected to skin-pass rolling, is being manufactured. Insufficient pickling allows the scale to remain on the surface, but excessive pickling mainly erodes grain boundaries, resulting in surface roughening or the like, which is a problem. The surface roughness during pickling is adjusted by controlling the pickling time, i.e., the traveling speed. The preferable neutral salt electrolytic pickling conditions are as follows. Acid: $Na_2SO_4$; acid concentration: about 30 to about 100 g/l; acid temperature: about 60 to about 90° C.; and pickling time: about 5 to about 60 seconds. The preferable nitric-hydrofluoric mixed acid pickling conditions are as follows. Acid: $HF+HNO_3$; acid concentration: about 5 to about 20 g/l; acid temperature: about 50 to about 70° C.; and pickling time: about 5 to about 60 seconds. The preferable nitric acid electrolysis conditions are as follows. Acid: $HNO_3$; acid concentration: about 50 to about 200 g/l; acid temperature: about 50 to about 70° C.; and pickling time: about 5 to about 60 seconds.

(9) Skin-pass Rolling (SK)

Skin-pass rolling corrects the shape of the cold-rolled annealed sheet and adjusts the roughness of the surface. The average surface roughness can be adjusted by controlling the average surface roughness Ra of the skin-pass rolls according to Japanese Industrial Standard (JIS) B 0601 within the range of about 0.05 to about 1 μm and controlling the reduction within the range of about 0.05% to approximately about 10%. The brittle resistance to secondary processing can be improved at an average surface roughness Ra of about 0.3 μm or less. However, an average surface roughness Ra of about 0.05 μm or less causes an increase in the contact resistance between the mold and the steel sheet surface and thus deteriorates the deep-drawability. Moreover, the sheet surface exhibits a high adhesion to an overcoating film when the surface has a suitable degree of roughness since the contact area between the coating and the steel sheet surface is increased.

(10) Overcoating

In actual environment, stainless steels must have high corrosion resistance particularly at crevices, welds, and portions where different metals come into contact. A steel material is selected based on the required corrosion resistance of these portions. Therefore, the remaining portions are provided with excessively high corrosion resistance. However, by applying an overcoat to part or all of the steel sheet to provide high corrosion resistance to the crevices, welds, and portions where different metals come into contact, a stainless steel material having a low alloying element content can be used instead.

A film of a room-temperature setting type or a thermosetting type is preferred in the invention. An overcoating film is made by applying a mixture of a resin, a pigment, and a solvent on the steel sheet and leaving the applied coat to stand in room temperature or heating the applied coat if necessary to dry the applied coat. A hard overcoating film containing a resin and a pigment is thus obtained. The resin is selected from urethane resins, epoxy resins, fluorocarbon resins, acrylic resins, and silicone resins. The pigment is added to improve the dispersibility of the resin and physical properties of the film and to control drying and hardening of the film. The pigment comprises a drying agent, a hardener, a plasticizer, an emulsifier, a metal powder selected from zinc, aluminum, stainless steel, and the like for preventing rust, and a color pigment. The solvent is a diluent, such as a thinner, containing an organic solvent.

The resin coating may be applied by a known coating method such as spraying coating, powder coating, cationic electrodeposition coating, or the like. In electrodeposition coating, an excellent overcoating film can be obtained by chemically converting an alkaline-degreased steel sheet and then performing cationic electrodeposition coating.

A silicone resin, an acrylic resin, or the like, infused in the resin coating film, improves not only the corrosion resistance but also the workability since it decreases the friction coefficient of the steel sheet surface.

The above-described steel sheet of the invention can be welded by any common welding method. Examples of such methods include but are not limited to electric arc welding such as tungsten inert gas (TIG) welding and metal inert gas (MIG) welding, resistance welding such as seam welding, and laser welding.

EXAMPLES

Example 1

Steels A1 to A26 having compositions shown in Table 1 were processed into steel slabs by continuous casting. The resulting slabs were heated again to 1,150° C. and rough-rolled at 950 to 1,100° C. In rough rolling, at least one pass was performed at a reduction rate of 40–60%. Each rough-rolled slab was finish-rolled at a rolling temperature ranging from 750 to 900° C. by a 7-stand rolling mill, at least one pass of which was performed at a reduction rate of 20 to 40%. After hot rolling, the sheet was cooled at an average cooling rate of 30° C./min and coiled to obtain a hot-rolled steel sheet having a sheet thickness of 5.0 mm. The hot rolled steel sheet was then annealed at 890 to 950° C., pickled, and cold-rolled once to a thickness of 0.8 mm (the total reduction rate: 84%). In cold rolling, the roll roughness was 0.05 to 1.0 μm and a unidirectional tandem rolling mill having a roll diameter of 400 mm or more was used. The linear pressure was at least 3.5 MN/m. After cold rolling, finish annealing was performed at 880 to 960° C. for 30 seconds. The finish annealed sheet was subjected to neutral salt electrolysis (acid: $Na_2SO_4$; acid concentration: 30 to 100 g/l; acid temperature: 60 to 90° C.; pickling time: 5 to 60 seconds). Subsequently, the sheet was pickled with a mixed acid (acid: $HF+HNO_3$; acid concentration 5 to 20 g/l; acid temperature 50 to 70° C.; pickling time 5 to 60 seconds) and then by nitric acid immersion (acid: $HNO_3$; acid concentration 50 to 200 g/l; acid temperature: 50 to 70° C.; pickling time: 5 to 60 seconds). The resulting sheet was subjected to skin-pass rolling with skin-pass rolls having a roll roughness of 0.04 to 0.15 μm at a reduction rate of 0.5%. Three specimens from each steel were sampled from the center region in the width direction 10 m from the tip of the steel sheet coil and subjected to tensile testing. The average r value, brittleness transition temperature, average crystal grain diameter, and average surface roughness of the specimens were measured. Part of steels A4, A16, and A26 was chemically converted with Surfdine SD2500MZL (manufactured by Nippon Paint Co., Ltd.) solution and provided with coating of various thicknesses by cationic electrolysis with Powertop V-20 (epoxy resin coating material, manufactured by Nippon Paint Co., Ltd.) to test the adhesion of the coating film and the corrosion resistance after coating.

TABLE 1

| No. | C | Si | Mn | P | S | Cr | Al | Ni | Cu | Co | Nb | Ti | N | B | V | Ca |
|---|---|---|---|---|---|---|---|---|---|---|---|---|---|---|---|---|
| A1 | 0.008 | 0.40 | 0.30 | 0.028 | 0.005 | 18.0 | 0.002 | 0.001 | 0.0010 | 0.0010 | 0.3300 | 0.001 | 0.008 | 15 ppm | 0.010 | 11 ppm |
| A2 | 0.004 | 0.10 | 0.30 | 0.035 | 0.003 | 16.5 | 0.003 | 0.001 | 0.0010 | 0.0010 | 0.3500 | 0.080 | 0.018 | 18 ppm | 0.121 | 18 ppm |
| A3 | 0.005 | 0.06 | 0.15 | 0.025 | 0.005 | 17.8 | 0.001 | 0.001 | 0.0020 | 0.0003 | 0.0010 | 0.270 | 0.007 | 21 ppm | 0.004 | 20 ppm |
| A4 | 0.004 | 0.11 | 0.15 | 0.027 | 0.006 | 18.0 | 0.002 | 0.100 | 0.0010 | 0.0010 | 0.0006 | 0.281 | 0.007 | 40 ppm | 0.110 | 35 ppm |
| A5 | 0.004 | 0.10 | 0.15 | 0.030 | 0.005 | 18.0 | 0.002 | 0.001 | 0.0010 | 0.0010 | 0.0010 | 0.310 | 0.009 | 4 ppm | 0.004 | 18 ppm |
| A6 | 0.004 | 0.11 | 0.14 | 0.026 | 0.005 | 18.1 | 0.006 | 0.012 | 0.0010 | 0.0005 | 0.0007 | 0.254 | 0.007 | 93 ppm | 0.004 | 22 ppm |
| A7 | 0.004 | 0.11 | 0.15 | 0.027 | 0.006 | 18.0 | 0.002 | 0.001 | 0.0010 | 0.0010 | 0.0010 | 0.251 | 0.007 | 110 ppm | 0.006 | 12 ppm |
| A8 | 0.005 | 0.06 | 0.15 | 0.025 | 0.005 | 17.8 | 0.003 | 0.001 | 0.3000 | 0.0010 | 0.0010 | 0.270 | 0.007 | 21 ppm | 0.005 | 15 ppm |
| A9 | 0.004 | 0.11 | 0.15 | 0.027 | 0.006 | 18.0 | 0.002 | 0.001 | 0.0010 | 0.1000 | 0.0010 | 0.270 | 0.007 | 21 ppm | 0.005 | 22 ppm |
| A10 | 0.005 | 0.10 | 0.14 | 0.025 | 0.005 | 18.1 | 0.004 | 0.150 | 0.0200 | 0.0400 | 0.0001 | 0.264 | 0.006 | 20 ppm | 0.061 | 0 ppm |
| A11 | 0.006 | 0.11 | 0.13 | 0.024 | 0.006 | 18.0 | 0.003 | 0.150 | 0.0040 | 0.1000 | 0.0020 | 0.255 | 0.008 | 21 ppm | 0.005 | 22 ppm |
| A12 | 0.006 | 0.11 | 0.13 | 0.024 | 0.006 | 18.0 | 0.003 | 0.300 | 0.5100 | 0.2000 | 0.0030 | 0.218 | 0.006 | 30 ppm | 0.068 | 16 ppm |
| A13 | 0.003 | 0.19 | 0.09 | 0.023 | 0.004 | 25.0 | 0.013 | 0.150 | 0.0020 | 0.0040 | 0.0230 | 0.001 | 0.007 | 13 ppm | 0.003 | 20 ppm |
| A14 | 0.005 | 0.06 | 0.15 | 0.025 | 0.005 | 17.8 | 0.001 | 0.001 | 0.0020 | 0.0040 | 0.0010 | 0.270 | 0.007 | 21 ppm | 0.004 | 0 ppm |
| A15 | 0.003 | 0.06 | 0.21 | 0.022 | 0.003 | 18.1 | 0.001 | 0.001 | 0.0020 | 0.0005 | 0.0010 | 0.270 | 0.007 | 26 ppm | 0.004 | 10 ppm |
| A16 | 0.005 | 0.04 | 0.15 | 0.025 | 0.005 | 17.8 | 0.001 | 0.001 | 0.0020 | 0.0005 | 0.0010 | 0.270 | 0.007 | 21 ppm | 0.004 | 20 ppm |
| A17 | 0.009 | 0.06 | 0.05 | 0.025 | 0.005 | 18.0 | 0.001 | 0.001 | 0.0020 | 0.0040 | 0.0090 | 0.270 | 0.007 | 21 ppm | 0.005 | 32 ppm |
| A18 | 0.004 | 0.22 | 0.08 | 0.026 | 0.006 | 17.6 | 0.002 | 0.050 | 0.0020 | 0.0030 | 0.0900 | 0.150 | 0.007 | 17 ppm | 0.110 | 20 ppm |
| A19 | 0.001 | 0.40 | 0.01 | 0.013 | 0.002 | 14.8 | 0.080 | 0.001 | 0.2000 | 0.2000 | 0.0010 | 0.052 | 0.001 | 30 ppm | 0.101 | 0 ppm |
| A20 | 0.008 | 0.81 | 0.31 | 0.010 | 0.001 | 11.8 | 0.210 | 0.001 | 0.0010 | 0.0010 | 0.3300 | 0.013 | 0.003 | 15 ppm | 0.150 | 0 ppm |
| A21 | 0.005 | 0.08 | 0.11 | 0.010 | 0.005 | 21.0 | 0.030 | 0.001 | 0.1100 | 0.0210 | 0.0010 | 0.150 | 0.001 | 40 ppm | 0.053 | 10 ppm |
| A22 | 0.008 | 0.01 | 0.11 | 0.230 | 0.001 | 17.1 | 0.001 | 0.130 | 0.0920 | 0.0200 | 0.0011 | 0.221 | 0.015 | 23 ppm | 0.331 | 0 ppm |
| A23 | 0.005 | 0.21 | 0.12 | 0.018 | 0.005 | 17.0 | 0.021 | 0.131 | 0.0001 | 0.0310 | 0.0001 | 0.000 | 0.008 | 13 ppm | 0.110 | 0 ppm |
| A24 | 0.005 | 0.22 | 0.11 | 0.018 | 0.005 | 16.8 | 0.030 | 0.110 | 0.0001 | 0.0210 | 0.2200 | 0.290 | 0.008 | 13 ppm | 0.110 | 0 ppm |
| A25 | 0.002 | 0.08 | 0.20 | 0.023 | 0.005 | 16.9 | 0.033 | 0.001 | 0.1310 | 0.0200 | 0.0010 | 0.250 | 0.011 | 0 ppm | 0.002 | 0 ppm |
| A26 | 0.008 | 0.12 | 1.00 | 0.015 | 0.005 | 9.8 | 0.020 | 0.110 | 0.2000 | 0.0500 | 0.0500 | 0.180 | 0.015 | 13 ppm | 0.110 | 10 ppm |

| No. | $18 \leqq Nb/(C+N)+2(Ti/(C+N)) \leqq 60$ | $0.05 < (0.55 \times Cu + 0.85 \times Co + Ni) < 0.30$ | Reference |
|---|---|---|---|
| A1 | 20.69 | 0.002 | Invention |
| A2 | 23.18 | 0.002 | Invention |
| A3 | 45.08 | 0.002 | Invention |
| A4 | 51.15 | 0.101 | Invention |
| A5 | 47.77 | 0.002 | *C.E. |
| A6 | 46.25 | 0.012 | Invention |
| A7 | 45.73 | 0.002 | *C.E. |
| A8 | 45.08 | 0.018 | Invention |
| A9 | 49.18 | 0.086 | Invention |
| A10 | 48.01 | 0.185 | Invention |
| A11 | 36.57 | 0.235 | Invention |
| A12 | 36.58 | 0.498 | Invention |
| A13 | 23.20 | 0.185 | *C.E. |
| A14 | 45.08 | 0.005 | Invention |
| A15 | 54.10 | 0.002 | Invention |
| A16 | 45.08 | 0.002 | Invention |
| A17 | 34.31 | 0.005 | Invention |

TABLE 1-continued

| | | | |
|---|---|---|---|
| A18 | 35.45 | 0.053 | Invention |
| A19 | 52.50 | 0.182 | Invention |
| A20 | 32.36 | 0.002 | Invention |
| A21 | 51.90 | 0.025 | Invention |
| A22 | 19.27 | 0.152 | *C.E. |
| A23 | 0.02 | 0.157 | *C.E. |
| A24 | 61.54 | 0.128 | *C.E. |
| A25 | 38.54 | 0.025 | *C.E. |
| A26 | 17.83 | 0.164 | *C.E. |

*C.E. = Comparative Example

Each of the above-described properties was examined according to the following procedures.

(1) Tensile Characteristics

Tensile strength (TS) and elongation (El.) were measured according to Japanese Industrial Standard (JIS) Z 2241 with JIS 13B test pieces for tensile testing. Regarding the r-value, three JIS 13B test pieces were sampled parallel to the rolling direction (L), at 45 degrees in the rolling direction (D), and perpendicular to the rolling direction (C), respectively, and 15% uniaxial tensile prestrain was applied thereto to obtain r-values $r_L$, $r_D$, and $r_C$ in these directions. The average r-value was then determined by the formula:

$$\text{Average } r\text{-value}=(r_L+2r_D+r_C)/4$$

(2) Average Crystal Grain Diameter

The ferrite crystal grain diameter numbers in a cross-section of the resulting finish annealed sheet taken in the rolling direction (L) at positions corresponding to ½, ¼, and ⅙ of the sheet thickness were determined according to JIS G 0552 (cutting method). To indicate the diameter in terms of μm, subsequently, crystal grains were approximated into circles based on n (the number of crystal grains in a 1.0 $mm^2$ cross-section) calculated according to JIS G 0552. Crystal grain radius r was determined from $n \times r^2 \times \pi$(circular constant: 3.14)=1.0 $mm^2$ and the crystal grain diameter (2r) was calculated. For example, when the crystal grain diameter number is 6.0, n is 512, the average cross-sectional area of the crystal grain is 0.00195 $mm^2$, and the crystal grain diameter based on the circular approximation is 49.8 μm.

(3) Average Surface Roughness Ra

The average surface roughness Ra of the steel sheet was adjusted by controlling the average surface roughness Ra of the rolls and the reduction ratio during final cold rolling or skin-pass rolling following finish annealing. The average surface roughness Ra of the rolls was varied within the range of 0.001 to 1.0 μm. The reduction rate was varied within the range of 0.5 to 3%. The average roughness of the steel sheet surface was measured according to JIS B 0601. The surface roughness of the steel sheet was measured at 5 points in a direction perpendicular to the rolling direction by a contact method, and the average value thereof was calculated.

(4) Brittleness Transition Temperature

The transition temperature is the temperature at which the fracture behavior shifts from ductile fracture to brittle fracture. The transition temperature is one of the references for evaluating the brittleness resistance of the steel sheet to secondary processing and was measured as follows. A test piece having a diameter of 50 mm was punched out from each finish annealed sheet 0.8 mm in thickness. The specimen was drawn into a cup 24.4 mm in diameter with double greasing according to a conical cup test (blank diameter: 50 mm; punch diameter: 17.46 mm; die shoulder R: 4.0 mm; die hole diameter: 19.95 mm; die opening angle: 60°; lubricating oil (machine oil JIS K 2238, ISO VC46, Idemitsu Diana Fresia U46) after degreasing). The concave portions of the flange were marked, and the cup was cut to have a height of 21 mm. After the cup was maintained at a predetermined testing temperature, they were placed with the marked concave portions upward. A 4.0 kg cylindrical weight was dropped thereto from a height of 80 cm to examine whether longitudinal cracks were generated. The testing temperature was varied from +80° to −80°, and the temperature which generated longitudinal cracks was determined to be the transition temperature. Three test pieces were taken from each steel and the brittle resistance to secondary processing was assumed to be excellent when all of the three pieces had a transition temperature of −60° or less.

(5) Compatibility with Overcoating Film

The compatibility with an overcoating film, i.e., the adhesion to the overcoating film, and the corrosion resistance of the resin coating film were evaluated. A test piece with a resin coating film thereon was inscribed by a cutter knife to form a 40 mm×40 mm incised checker-board pattern having a line interval of 5 mm. The scribed test piece was subjected to a salt spray test for 200 hours with 3.5% NaCl solution (30° C.) to evaluate secondary adhesion and rust resistance. In evaluation, grade A (excellent) indicates that neither peeling nor rust was observed; grade B (good) indicates that no peeling but minute rust was observed; grade C (fair) indicates that minute peeling and rust were observed; and grade D (poor) indicates that peeling and rust were observed. In actual application, grade B or above is required.

(6) Thickness of Overcoating Film

As for the coated steel sheet products, samples were cut out from any desired five points of the steel sheet. The cross-section taken in the rolling direction was buried in a resin and the thickness measured at a ×50 to ×200 magnification. The thickness of each sample was defined as an average value of the thicknesses taken at six points in the sample. As for the steel sheet samples subjected to coil coating, a board having a width of 300 mm was cut out from the center of the sheet in the sheet width direction 3 m from the tip of the coil. A 2 cm×2 cm test piece was cut out from the board from five random positions, and the thickness of the film in the cross-section taken along the rolling direction was measured at six positions. The results were averaged and the average thickness was defined as the thickness of the overcoating film.

(7) Corrosion Resistance

The coated steel sheet was exposed to 3.5% NaCl solution spray (30° C.) for 200 hours (salt-spray test) to conduct a cross-cut adhesion test and examine occurrence of rust. The samples were visually compared. A salt wet-dry alternate cyclic corrosion test was performed to evaluate perforation corrosion resistance. The test conditions were as follows. CCT: 35° C.; 5% NaCl salt spray×0.5 hour→60° C. dry×1 hour→40° C. wet atmosphere (relative humidity≧95%)×1 hour. After 30 cycles, the maximum corrosion depth in the steel sheet was evaluated. The maximum corrosion depth was measured at 10 positions and the results were averaged. A steel sheet having an average maximum corrosion depth of less than 3 μm was designated as excellent. A steel sheet having an average maximum corrosion depth of 3 to 5 μm was designated as good. A steel sheet having an average maximum corrosion depth exceeding 5 μm was designated as poor.

ondary processing, i.e., brittleness transition temperatures of −60° C. or less, as a result of optimizing the average crystal grain diameter and the average surface roughness. The steels outside the composition ranges of the invention did not satisfy the required average r-values and transition temperatures although the average crystal grain diameter and the average surface roughness were within the ranges of the invention.

The average crystal grain diameter of steel A4 of the invention was varied from 17 to 100 μm by mainly adjusting the finish annealing conditions after final cold rolling, and the average surface roughness Ra of the steel sheet was varied from 0.03 to 1.21 μm by changing the average roll surface roughness Ra from 0.1 to 1.0 μm to determine the

TABLE 2

| No. | Steel No. | Tensile characteristics TS(MPa) | Tensile characteristics El(%) | Average crystal grain diameter (μm) | Average r-value | Average surface roughness Ra (μm) | Brittleness transition temperature (° C.) | Reference |
|---|---|---|---|---|---|---|---|---|
| 1 | A1 | 505 | 31.3 | 27 | 2.03 | 0.09 | −60 | Invention |
| 2 | A2 | 435 | 34.2 | 38 | 2.21 | 0.05 | −65 | Invention |
| 3 | A3 | 445 | 34.0 | 30 | 2.13 | 0.05 | −65 | Invention |
| 4 | A4 | 449 | 33.5 | 35 | 2.21 | 0.07 | −70 | Invention |
| 5 | A5 | 440 | 33.8 | 30 | 2.17 | 0.08 | −30 | * C.E. |
| 6 | A6 | 465 | 32.0 | 29 | 2.08 | 0.08 | −60 | Invention |
| 7 | A7 | 472 | 31.5 | 29 | 2.01 | 0.08 | −65 | Invention |
| 8 | A8 | 452 | 33.1 | 30 | 2.13 | 0.08 | −65 | Invention |
| 9 | A9 | 455 | 32.8 | 30 | 2.10 | 0.06 | −65 | Invention |
| 10 | A10 | 453 | 32.5 | 27 | 2.08 | 0.06 | −70 | Invention |
| 11 | A11 | 455 | 32.7 | 31 | 2.14 | 0.04 | −75 | Invention |
| 12 | A12 | 470 | 31.0 | 34 | 2.08 | 0.06 | −60 | Invention |
| 13 | A13 | 540 | 27.1 | 30 | 1.59 | 0.09 | −20 | * C.E. |
| 14 | A14 | 450 | 33.5 | 30 | 2.23 | 0.05 | −65 | Invention |
| 15 | A15 | 451 | 34.1 | 37 | 2.31 | 0.05 | −60 | Invention |
| 16 | A16 | 4S1 | 34.1 | 37 | 2.31 | 0.05 | −60 | Invention |
| 17 | A17 | 450 | 34.0 | 35 | 2.28 | 0.05 | −60 | Invention |
| 18 | A18 | 530 | 29.2 | 26 | 1.80 | 0.05 | −40 | * C.E. |
| 19 | A19 | 398 | 37.1 | 39 | 2.40 | 0.08 | −85 | Invention |
| 20 | A20 | 421 | 36.1 | 42 | 2.28 | 0.15 | −70 | Invention |
| 21 | A21 | 460 | 33.5 | 35 | 2.15 | 0.05 | −65 | Invention |
| 22 | A22 | 480 | 32.1 | 39 | 2.03 | 0.28 | −55 | * C.E. |
| 23 | A23 | 470 | 29.0 | 38 | 1.35 | 0.10 | −40 | * C.E. |
| 24 | A24 | 481 | 31.0 | 35 | 1.88 | 0.11 | −50 | * C.E. |
| 25 | A25 | 465 | 32.2 | 34 | 2.21 | 0.07 | −45 | * C.E. |
| 26 | A26 | 455 | 30.1 | 38 | 1.60 | 0.15 | −50 | * C.E. |

* C.E. = Comparative Example

Table 2 shows the tensile characteristics, i.e., tensile strength (TS) and elongation (El), the average crystal grain diameter, the average r-value, the average surface roughness Ra, and the brittleness transition temperature of each of steels A1 to A26. The steels containing less solid solution carbon and nitrogen and adequate amounts of Ti, Nb, and B satisfying the composition ranges of the invention all showed high r-values, i.e., average r-values of 2.0 or more. Moreover, they exhibited superior brittle resistance to sectensile characteristics, the average crystal grain diameter, the average revalue, the average surface roughness Ra, and the brittleness transition temperature of steel A4. The results are shown in Table 3. The results demonstrate that although the average r-value is still satisfactory at an average crystal grain diameter exceeding 40 μm or at an average surface roughness exceeding 0.3 μm, the brittleness transition temperature exceeds −60° C., resulting in a deterioration in brittle resistance to secondary processing.

TABLE 3

| No. | Steel No. | Tensile characteristics TS(MPa) | Tensile characteristics El(%) | Average crystal grain diameter (μm) | Average r-value | Average surface roughness Ra (μm) | Brittleness transition temperature (° C.) | Reference |
|---|---|---|---|---|---|---|---|---|
| 27 | A4 | 455 | 33.1 | 17 | 2.04 | 0.07 | −70 | Invention |
| 28 | A4 | 453 | 33.2 | 21 | 2.13 | 0.07 | −70 | Invention |
| 29 | A4 | 449 | 33.5 | 35 | 2.21 | 0.07 | −70 | Invention |
| 30 | A4 | 448 | 33.7 | 38 | 2.28 | 0.07 | −72 | Invention |
| 31 | A4 | 447 | 34.0 | 43 | 2.35 | 0.07 | −58 | * C.E. |
| 32 | A4 | 445 | 34.3 | 57 | 2.38 | 0.07 | −40 | * C.E. |
| 33 | A4 | 447 | 34.3 | 72 | 2.41 | 0.07 | −40 | * C.E. |

TABLE 3-continued

| No. | Steel No. | Tensile characteristics TS(MPa) | El(%) | Average crystal grain diameter (μm) | Average r-value | Average surface roughness Ra (μm) | Brittleness transition temperature (° C.) | Reference |
|---|---|---|---|---|---|---|---|---|
| 34 | A4 | 443 | 34.5 | 83 | 2.44 | 0.07 | −5 | * C.E. |
| 35 | A4 | 445 | 33.2 | 100 | 2.35 | 0.07 | 10 | * C.E. |
| 36 | A4 | 449 | 33.5 | 35 | 2.21 | 0.03 | −75 | Invention |
| 37 | A4 | 449 | 33.5 | 35 | 2.19 | 0.15 | −75 | Invention |
| 38 | A4 | 449 | 33.5 | 35 | 2.21 | 0.28 | −75 | Invention |
| 39 | A4 | 449 | 33.4 | 34 | 2.23 | 0.32 | −58 | * C.E. |
| 40 | A4 | 450 | 32.9 | 35 | 2.18 | 0.50 | −55 | * C.E. |
| 41 | A4 | 450 | 33.5 | 34 | 2.21 | 1.21 | −50 | * C.E. |

* C.E. = Comparative Example

The compatibility with an overcoating, i.e., secondary adhesion and rust resistance, and the perforation corrosion resistance of steels A4 and A16 of the invention and steel A26 of a comparative example after coating were examined. The results are shown in Table 4. Table 4 shows that an average surface roughness Ra exceeding 0.3 μm deteriorated the adhesion of the coating and increased the brittleness transition temperature. The coating film thickness needs to be about 2.0 μm or more for the steel of the invention to obtain satisfactory corrosion resistance. This thickness is one fifth or less of the thickness of common steels, i.e., approximately 10 μm or more. The steels of the invention exhibited superior characteristics regarding corrosion resistance of the coating. Table 4 also demonstrates that an average surface roughness of 0.05 μm or more is required to ensure a further superior compatibility with overcoating.

TABLE 4

| No. | Steel No. | Tensile characteristics TS (MPa) | El(%) | Average crystal grain diameter (μm) | Average r-value | Average surface roughness Ra(μm) | Brittleness transition temperature (° C.) | Compatibility with overcoat | Overcoating film thickness (μm) | Corrosion resistance | Reference |
|---|---|---|---|---|---|---|---|---|---|---|---|
| 42 | A4 | 449 | 33.5 | 35 | 2.21 | 0.03 | −75 | C | 6.0 | good | Invention |
| 43 | A4 | 449 | 33.5 | 35 | 2.19 | 0.15 | −75 | A | 6.0 | good | Invention |
| 44 | A4 | 449 | 33.5 | 35 | 2.21 | 0.28 | −75 | A | 6.0 | good | Invention |
| 45 | A4 | 449 | 33.4 | 34 | 2.23 | 0.32 | −58 | B | 6.0 | good | * C.E. |
| 46 | A4 | 450 | 32.9 | 35 | 2.18 | 0.50 | −55 | B | 6.0 | good | * C.E. |
| 47 | A4 | 450 | 33.5 | 34 | 2.21 | 1.21 | −50 | C | 6.0 | good | * C.E. |
| 48 | A4 | 449 | 33.5 | 35 | 2.21 | 0.28 | −75 | B | 1.5 | poor | Invention |
| 49 | A4 | 449 | 33.5 | 35 | 2.21 | 0.28 | −75 | A | 2.5 | good | Invention |
| 50 | A4 | 440 | 33.5 | 35 | 2.21 | 0.28 | −75 | A | 4.5 | good | Invention |
| 51 | A15 | 451 | 34.1 | 37 | 2.31 | 0.05 | −60 | A | 0.5 | poor | Invention |
| 52 | A16 | 451 | 34.1 | 37 | 2.31 | 0.05 | −60 | A | 1.7 | poor | Invention |
| 53 | A16 | 451 | 34.1 | 37 | 2.31 | 0.05 | −60 | A | 2.3 | good | Invention |
| 54 | A16 | 451 | 34.1 | 37 | 2.31 | 0.05 | −60 | A | 10.2 | good | Invention |
| 55 | A16 | 451 | 34.1 | 37 | 2.31 | 0.05 | −60 | A | 12.3 | good | Invention |
| 56 | A26 | 455 | 30.1 | 38 | 1.60 | 0.15 | −50 | A | 2.2 | poor | * C.E. |
| 57 | A26 | 455 | 30.1 | 38 | 1.60 | 0.15 | −50 | A | 4.1 | poor | * C.E. |

* C.E. = Comparative Example

Example 2

Steel slabs of steels A4, A5, and A10 having different boron contents, as shown in Table 1, were hot rolled under the same conditions as steels A4, A5, and A10 in EXAMPLE 1 except for the finish annealing temperature. After hot-rolled sheet was annealed and pickled, it was cold-rolled to a thickness of 0.8 mm. Subsequently, cold-rolled sheets were finish-annealed at various temperatures in the range of 840 to 990° C. to fabricate hot-rolled annealed sheets having various average crystal grain diameter ranging from 10 to 100 μm. The sheets were pickled and subjected to skin-pass rolling under the same conditions as steels A4, A5, and A10 in EXAMPLE 1. The brittleness transition temperatures of the resulting sheets were measured to evaluate the brittle resistance to secondary processing. The results are shown in FIG. 1. FIG. 1 demonstrates that sufficient toughness can be obtained by adjusting the average crystal grain diameter to 40 μm or less and the average surface roughness Ra to 0.3 μm or less.

What is claimed is:

1. A method for making a ferritic stainless steel sheet, comprising the steps of:

hot-rolling a steel slab comprising about 0.01 percent by mass or less of carbon; about 1.0 percent by mass or less of silicon; about 1.5 percent by mass or less of manganese; about 11 to about 23 percent by mass of chromium; about 0.06 percent by mass or less of phosphorous; about 0.03 percent by mass or less of sulfur; about 1.0 percent by mass or less of aluminum; about 0.04 percent by mass of nitrogen; about 0.0005 to about 0.01 percent by mass of boron; 0.004 to 0.3 percent by mass of vanadium; about 0.8 percent by mass or less of niobium and/or about 1.0 percent by mass or less of titanium wherein $18 \leqq Nb/(C+N)+2(Ti/(C+N)) \leqq 60$; and the balance being iron and unavoidable impurities to form a hot-rolled sheet;

annealing the hot-rolled sheet to form an annealed sheet;

cold-rolling the annealed sheet either once or at least two times with intermediate annealing to form a cold-rolled sheet;

finish-annealing and pickling the cold rolled sheet to form a pickled steel sheet containing crystal grains having an average crystal grain diameter of about 40 μm or less; and skin-pass rolling the pickled sheet with skin-pass rolls having a roughness of Ra of 0.05 to 1 μm at a reduction rate of 0.05 to 10% to obtain a sheet having an average surface roughness of about 0.3 μm or less.

2. The method according to claim 1, wherein the steel slab further comprises at least one of about 0.1 to about 1.0 percent by mass of copper; about 0.05 to about 0.2 percent by mass of cobalt; and about 0.1 to about 2.0 percent by mass of nickel, wherein $0.05<(0.55\times Cu+0.85\times Co+Ni)<0.30$.

3. The method according to claim 1, wherein the steel slab further comprises about 0.0007 to about 0.0030 percent by mass of calcium.

4. The method according to claim 2, wherein the steel slab further comprises about 0.0007 to about 0.0030 percent by mass of calcium.

5. The method according to one of claims 1 to 4, further comprising forming a resin coating film having a thickness of about 2.0 μm on a surface of the ferritic steel sheet.

6. The method according to claim 5, wherein the resin coating film comprises a urethane resin.

7. The method according to claim 5, wherein the resin coating film comprises an epoxy resin.

8. A method for making a ferritic stainless steel sheet, comprising the steps of:

hot-rolling a steel slab comprising about 0.01 percent by mass or less of carbon; about 1.0 percent by mass or less of silicon; about 1.5 percent by mass or less of manganese; about 11 to about 23 percent by mass of chromium; about 0.06 percent by mass or less of phosphorous; about 0.03 percent by mass or less of sulfur; about 1.0 percent by mass or less of aluminum; about 0.04 percent by mass of nitrogen; about 0.0005 to about 0.01 percent by mass of boron; 0.004 to about 0.3 percent by mass of vanadium; about 0.8 percent by mass or less of niobium and/or about 1.0 percent by mass or less of titanium wherein $18\leqq Nb/(C+N)+2(Ti/(C+N))\leqq 60$; and the balance being iron and unavoidable impurities to form a hot-rolled sheet;

annealing the hot-rolled sheet to form an annealed sheet;

cold-rolling the annealed sheet either once or at least two times with intermediate annealing to form a cold-rolled sheet;

finish-annealing and pickling the cold rolled sheet to form a pickled steel sheet containing crystal grains having an average crystal grain diameter of about 40 μm or less; and skin-pass rolling the pickled sheet to obtain a sheet having an average surface roughness of about 0.3 μm or less.

* * * * *

UNITED STATES PATENT AND TRADEMARK OFFICE

CERTIFICATE OF CORRECTION

PATENT NO. : 7,056,398 B2
APPLICATION NO. : 10/671384
DATED : June 6, 2006
INVENTOR(S) : Yazawa et al.

It is certified that error appears in the above-identified patent and that said Letters Patent is hereby corrected as shown below:

Column 13 & 14:
Table 1

At No. A3, subheading "Co", please change "0.0003" to --0.0005--;

At No. A5, subheading "Cu", please change "0.0010" to --0.0050--;

At No. A13, subheading "Cu", please change "0.0020" to --0.0200--;

At No. A13, subheading "Co", please change "0.0040" to --0.400--;

At No. A13, subheading "Nb", please change "0.0230" to --0.2300--;

At No. A16, subheading "Ca", please change "20 ppm" to --25ppm--; and

At No. A18, subheading "Mn", please change "0.08" to --0.080--.

Column 17 & 18:
Table 2

At No. 16, subheading "TS(Mpa)" please change "4S1" to --451--.

Signed and Sealed this

Seventeenth Day of October, 2006

JON W. DUDAS
*Director of the United States Patent and Trademark Office*